US007394890B1

(12) United States Patent
Wang et al.

(10) Patent No.: US 7,394,890 B1
(45) Date of Patent: Jul. 1, 2008

(54) OPTIMIZED X-RAY ENERGY FOR HIGH RESOLUTION IMAGING OF INTEGRATED CIRCUITS STRUCTURES

(75) Inventors: Yuxin Wang, Arlington Heights, IL (US); Wenbing Yun, Walnut Creek, CA (US); Frederick William Duewer, Albany, CA (US)

(73) Assignee: Xradia, Inc., Concord, CA (US)

( * ) Notice: Subject to any disclaimer, the term of this patent is extended or adjusted under 35 U.S.C. 154(b) by 58 days.

(21) Appl. No.: 10/983,415

(22) Filed: Nov. 8, 2004

Related U.S. Application Data

(60) Provisional application No. 60/518,369, filed on Nov. 7, 2003.

(51) Int. Cl.
*G21K 1/06* (2006.01)

(52) U.S. Cl. ..... 378/84; 378/43; 378/82

(58) Field of Classification Search ..... 378/43, 378/58, 82, 83, 84, 85
See application file for complete search history.

(56) References Cited

U.S. PATENT DOCUMENTS 4,365,156 A * 12/1982 Golovchenko et al. ..... 378/84
4,453,262 A * 6/1984 Buckley ..... 378/34
5,150,394 A * 9/1992 Karellas ..... 378/62
5,570,407 A * 10/1996 Pesante et al. ..... 378/58
5,650,616 A * 7/1997 Iketaki ..... 250/288
5,742,658 A * 4/1998 Tiffin et al. ..... 378/44
5,754,620 A * 5/1998 Hossain et al. ..... 378/45
5,965,065 A * 10/1999 Powell ..... 378/156
6,414,315 B1 * 7/2002 Wei et al. ..... 250/370.11
6,430,254 B2 * 8/2002 Wilkins ..... 378/43
2001/0046276 A1 * 11/2001 Schneider et al. ..... 378/58
2003/0108155 A1 * 6/2003 Wilkins et al. ..... 378/119
2003/0223536 A1 * 12/2003 Yun et al. ..... 378/45

OTHER PUBLICATIONS

Joachim Knoth, Harald Schneider and Heinrich Schwenke, Tunable exciting energies for total reflection x-ray fluorescence spectrometry using a tungsten anode and bandpass filtering, 1994, X-ray Spectrometry, vol. 23, 261-266.*

* cited by examiner

*Primary Examiner*—Chih-Cheng Glen Kao
(74) *Attorney, Agent, or Firm*—Houston Eliseeva LLP

(57) ABSTRACT

An x-ray imaging system uses particular emission lines that are optimized for imaging specific metallic structures in a semiconductor integrated circuit structures and optimized for the use with specific optical elements and scintillator materials. Such a system is distinguished from currently-existing x-ray imaging systems that primarily use the integral of all emission lines and the broad Bremstralung radiation. The disclosed system provides favorable imaging characteristics such as ability to enhance the contrast of certain materials in a sample, to use different contrast mechanisms in a single imaging system, and to increase the throughput of the system.

9 Claims, 7 Drawing Sheets

OPTIMIZED X-RAY ENERGY FOR HIGH RESOLUTION IMAGING OF INTEGRATED CIRCUITS STRUCTURES

RELATED APPLICATIONS

This application claims priority to U.S. Provisional Application No. 60/518,369, filed Nov. 7, 2003, which is incorporated herein by reference in its entirety.

BACKGROUND OF THE INVENTION

X-ray imaging is a valuable technology for non-destructive imaging applications in medicine and industrial research and development.

All x-ray imaging systems include a source that generates the x-ray beam, which is used to probe the object to be examined, and a detector system for collecting the x-ray beam. The x-ray source is typically an electron-bombardment, a laser-plasma, or a synchrotron radiation source. The detector system is typically based on x-ray film or an electronic, such as charge-coupled device (CCD), detector. In some cases, an intervening scintillator is used to convert the x-ray radiation to a wavelength that is detectable by the detector device.

Further, the x-ray beam is often modified by one or more beam-conditioning devices. Sometimes an energy filter, monochromator, or pinholes are place between the object or sample and the source. To focus the beam onto the sample a condenser lens, in the case of a full-field imaging microscope, or an objective lens, in the case of a scanning system, are typically used. The beam passing through the sample is then imaged to the detector by an objective lens, in the case of a full-field imaging microscope, or reaches the detector directly in the case of a scanning system.

SUMMARY OF THE INVENTION

Most existing x-ray imaging systems, e.g. medical x-ray, airport x-ray scans, use the full spectrum of the x-ray emission, including the characteristic lines of the anode material and the Brehmstralung emissions. The resulting image is therefore an integrated intensity over the entire spectrum.

A problem with this approach is that by using the entire spectrum, one looses an important attribute of x-ray imaging: the spectral sensitivity of various materials to x rays of different energies.

As a result, the present invention is directed to the notion of using one or more emission lines of electron bombardment x-ray sources to selectively image certain materials with high sensitivity. Specific examples are provided that illustrate the imaging of semiconductor integrated circuit devices.

The present invention is directed to using particular emission lines that are optimized for imaging specific metallic structures in a semiconductor integrated circuit structures and optimized for the use with specific optical elements and scintillator materials. Such a system is distinguished from currently-existing x-ray imaging systems that primarily use the integral of all emission lines and the broad Bremstralung radiation. The disclosed system provides favorable imaging characteristics such as the ability to enhance the contrast of certain materials in a sample, to use different contrast mechanisms in a single imaging system, and to increase the throughput of the system.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings:

FIGS. 3*a* and 3*b*: Illustrations of Fresnel zone plates, in which FIG. 3*a* is a zone plate having concentric opaque or phase shifting rings arranged such that the radiation passing through it will arrive is the focal point in phase; and FIG. 3*b* is an image of a Fresnel zone plate.

FIGS. 4*a* and 4*b*: Plots showing efficiency of a zone plate as a function of x-ray energy in which FIG. 4*a* is a plot for a zone plate made from 500 nanometer thick palladium; and FIG. 4*b* is a plot for a zone plate made from 1 micrometer thick of gold.

DETAILED DESCRIPTION OF THE PREFERRED EMBODIMENTS

A number of x-ray imaging systems are disclosed that utilize one or more atomic emission lines to image specific materials in a sample, taking advantage of the spectral absorption properties of the sample to produce high image contrast with appropriate imaging mechanisms. It also takes into account the response of optics and detectors at different x-ray energies. It deals, in particular, with materials used in current generation and next generation semiconductor integrated circuit devices.

Figure 1:
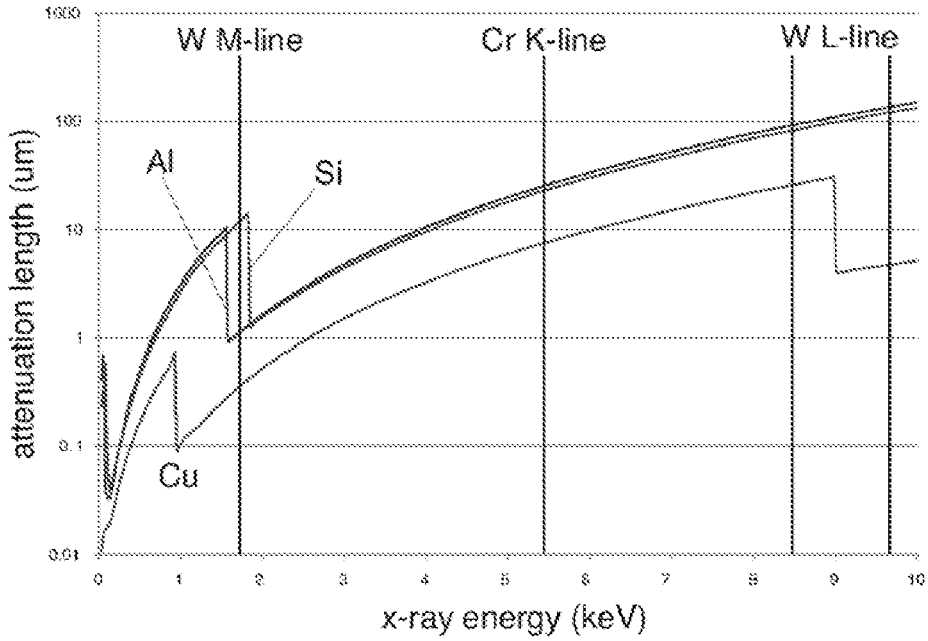
FIG. 1: The 1/e attenuation length of Al, Si, and Cu plotted as a function of x-ray energy. Also shown are the emission lines of W and Cr.

As an example, refer to FIG. 1, which shows the absorption spectrum of materials used most frequently in semiconductor devices: Copper, Aluminum, and Silicon. Typically copper or aluminum circuits are fabricated in a silicon substrate. To image the circuit structure, strong contrast is desirable between the circuit structure and the silicon substrate.

The interaction of x-rays with most materials is complex and strongly dependent on the x-ray energy. A good example is illustrated in FIG. 1, where the 1/e attenuation length of silicon, aluminum, and copper is plotted as a function of x-ray energy, and shown along with the emission lines of tungsten and chromium. The absorption properties of these materials vary dramatically as a function of the x-ray energy. Therefore different material properties of the sample can be probed by varying the x-ray energy used to image a sample.

For example, if the 1.8 keV x rays from tungsten M line is used to image an integrated circuit chip containing aluminum lines, the silicon substrate has relatively small attenuation while the aluminum lines will absorb strongly. Specifically, the aluminum line has an attenuation length of about 1 micrometer while silicon has an attenuation length of about 10 micrometers.

The plot shows that absorption contrast between silicon and aluminum is strong only between their absorption edges: aluminum K-edge at 1560 electron-Volts (eV) and silicon K-edge at 1850 eV. There is little contrast between these materials at other energies above 1 keV. Therefore an imaging system that uses the entire emission spectrum of a target (emission lines plus the Brehmstralung radiation) will exhibit very low contrast between the aluminum structures and the silicon substrate. An imaging system using only the tungsten M line (1800 eV), however, will be able to take advantage of the intrinsic absorption difference between Al and Si to image Al structures with good contrast.

The same considerations can be applied to imaging copper features as well. The absorption contrast between the copper lines and the silicon substrate is moderate at most energies but very strong between Cu L-edge at 1 keV and the silicon K-edge at 1.85 keV, and just above the Cu K-edge at 8.9 keV. To image Cu lines with high contrast, one should use x-ray energies within these two intervals. Two tungsten emission lines: $L_\beta$ at 9.7 keV and M line at 1.8 keV are well suited for this purpose.

For one layer of a typical aluminum chip with 1 micrometer thickness, the aluminum transmits about exp(−1)=34% of the radiation while the silicon substrate transmits about exp(−0.1)=90%. This difference in the absorption properties allows for the imaging of the integrated circuits with strong elemental contrast and therefore clearly imaging the aluminum structures.

In addition to imaging aluminum lines, the 1.8 keV emission from tungsten is also well suited for imaging copper lines in a integrated circuit chip since a similar absorption contrast exists between copper with 1/e attenuation length of 0.7 micrometers and silicon.

In another example, a tungsten source is used to image copper or aluminum features in an integrated circuit chip. In this case, the 1.8 keV M-line is just below the silicon K absorption edge, but above the absorption edges of copper (Cu) (L line at 1 keV) and aluminum (Al) (K line at 1.5 keV). Therefore a sufficient absorption contrast is available between the Cu or Al structures and a silicon substrate, thereby allowing the imaging of Cu or Al lines in an integrated circuit chip. In other examples, Cu or Al structures are imaged on dielectric substrates. Some examples of dielectrics include: $1^{st}$ Generation with $2.8 \leqq k \leqq 3.5$: fluorinated-oxide film, also referred to as fluorinated silica glass (FSG) used for 0.25-0.5 um technology; $2^{nd}$ Generation with $2.5 \leqq k \leqq 2.8$: poly(alylene) ethers (PAE); and ultralow k dielectrics with $k<2.0$: nanoporous silica ($SiO_2$) xerogel materials.

Currently existing x-ray imaging systems typically use the full spectrum of the x-ray emission, including all the characteristic lines of the anode material and the Brehmstralung emission. These systems are therefore not able to take advantage of the energy-dependent x-ray imaging possibilities. It would be very difficult to image aluminum structures with these systems since the material contrast is only strongly exhibited near the absorption edge while the x-ray emission far from the edge does not produce strong image contrast between the aluminum features and the silicon substrate, therefore diluting the image contrast.

In practice the attenuation length of the silicon (10 micrometers) requires the IC sample to be thinned to about similar thickness to obtain sufficient transmission. If the tungsten Lb emission (9.7 keV) line is used instead, the silicon attenuation length becomes 120 micrometers. Consequently, a sample thickness of over 100 micrometers can be tolerated. At this energy the attenuation length of copper becomes about 5 micrometers, and a strong absorption contrast still exists between the copper lines and silicon substrate. In comparison, the 1.8 keV emission is better suited for imaging fine feature since the 0.5 micrometers provides very high sensitivity, while the 9.7 keV x ray is better suited for imaging complex circuit structures in intact integrated circuit (IC) dies because the larger 5 micrometers attenuation length allows the penetration of a thick stack of copper line structures while maintaining high contrast against the silicon substrate.

The long attenuation length in silicon also eliminates the need to thin the IC sample and thus simplifies the sample preparation process. For chips with very complex copper structures, the integrated copper thickness may exceed 10 micrometers. This thickness may be too opaque for the 9.7 keV x-ray. In this case the tungsten $L_\alpha$ line (8.4 keV) may be used. Since it is just below the copper absorption edge, it has relatively large attenuation length of about 15 micrometers. At this energy, however, the absorption contrast between copper and silicon substrate is reduced.

A suitable phase contrast imaging method, such as a Zernike configuration (FIG. 2) or differential phase contrast methods can be used to boost the contrast of the copper features, especially the features with small lateral and thickness dimensions.

Figure 2:
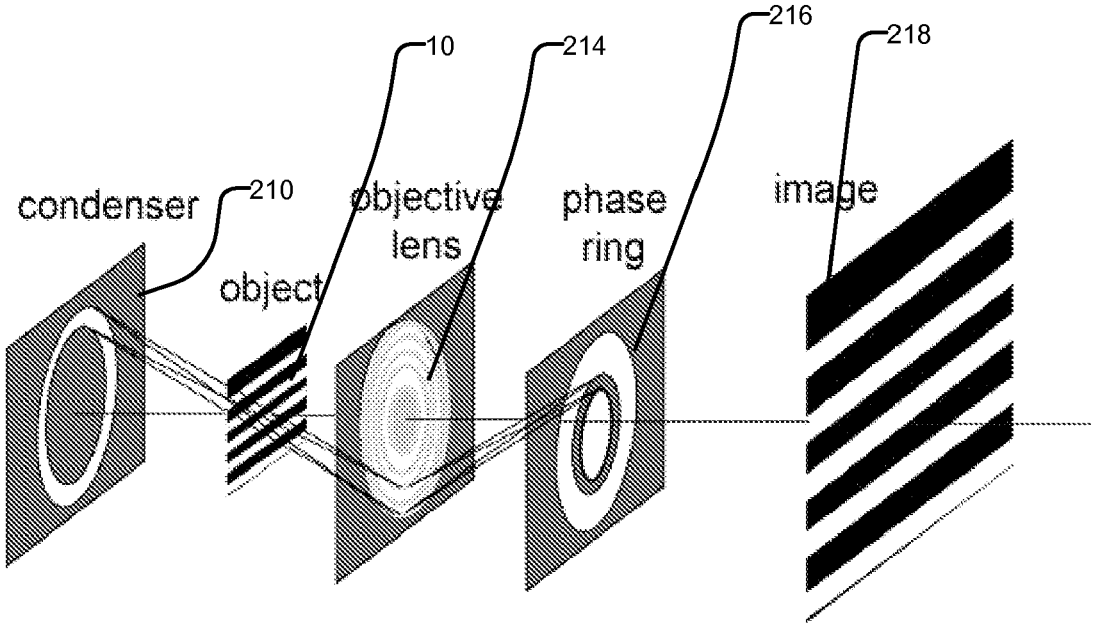
FIG. 2: Illustration of the Zernike phase contrast scheme. A ring condenser projects radiation to the object. A phase ring is placed in the back focal plane. Its shape is the image of the condenser formed by the objective lens. In this scheme, the direct radiation imaged by the objective is phase shifted by the phase ring while the radiation scattered by the object is, in most part, unaffected by the phase ring. These two beams interfere at the image plane to produce a phase-contrast image.

Specifically, in FIG. 2, a condenser 210 is used to concentrate X-ray radiation on a sample or object 10. An objective lens 214 is used to collect the radiation after interaction with the sample 10. A phase ring 216 is used to create a relative phase shift between the diffracted and undiffracted radiation to create the phase contrast image 218.

Depending on the implementation, the condenser lens 210 may include refractive optics, reflective optics, diffractive optics. The objective lens 214 includes Fresnel zone plates, reflective mirrors lens, refractive lens, or achromatic Fresnel optics.

Both tungsten L and M are well suited to image IC chips with copper structures, but with different properties. An imaging system using a tungsten x-ray source that is able to utilize all L and M lines is able to satisfy a wide range of applications for imaging IC circuits. These may include failure analysis, process development and reverse engineering.

Another consideration in imaging is that the materials must be sufficiently transmissive to allow sufficient light or radiation to penetrate the sample to be detected. In the previous example with Cu lines, the attenuation length for Cu is 0.5 micrometers at 1.8 keV and 6 micrometers at 9.7 keV. These dimensions are good for detecting small features, but a modern integrated circuit chip may contain up to 7 or 8 layers of copper structures with integrated thickness exceeding 10 micrometers. Such structures may not permit sufficient transmission for detection at these two energies, but the W $L_\alpha$ line at 8.4 keV is just below the Cu K-edge and has an attenuation length of about 30 micrometers. This allows the imaging of Cu structures of large integrated thickness, but with reduced imaging contrast. The contrast can be improved by using phase contrast techniques. The phase contrast depends on the relative mass density of materials in the sample. It is therefore relatively uniform through the energy spectrum, except for some abrupt changes near absorption edges. The Zernike phase contrast imaging method shown in FIG. 2 is commonly used in light microscopy and can be applied in x-ray imaging. Here, a ring condenser, instead of a full condenser used in bright-field imaging, projects radiation to the object. A phase ring is placed in the back focal plane. The shape of this phase ring is the image of the condenser formed by the objective lens. In this scheme, the direct radiation imaged by the objective is phase shifted by the phase ring while the radiation scattered by the object is unaffected by the phase ring (except for a small portion that passes the phase ring). These two beams interfere at the image plane to produce a phase-contrast image.

With this method, ten-fold increase in contrast can be gained for Cu features at 8.4 keV compared with absorption contrast. One disadvantage of phase contrast imaging, however, is that the resulting imaging is not a linear map of some material properties of the sample, while using absorption contrast imaging, the resulting image is the integrated absorption map of the attenuation through the sample. Having a linear map makes the image easy to interpret and allows the use of a simple tomography algorithm to reconstruct the 3 D structure of the sample. The three dimensional tomography algorithm using phase contrast images is difficult.

Phase contrast mechanism can be applied to image aluminum features in silicon substrates as well, as little absorption contrast exists between aluminum and silicon, except for a very narrow spectral band. Aluminum structures can be imaged with contrast gain of up to 20, at most energies, with Zernike phase contrast scheme.

The spectral response of the optical components in an imaging system must also be considered. The optical train must be designed in an integrated approach.

Note that, in comparison, no appreciable absorption contrast exists between Al and Si at energies above the silicon K-absorption edge.

In addition to optimizing the x-ray energy for the best intrinsic contrast from the sample, one must also consider the effect on the optical train of the imaging system, most importantly the objective lens and the detector system.

Figure 3A:
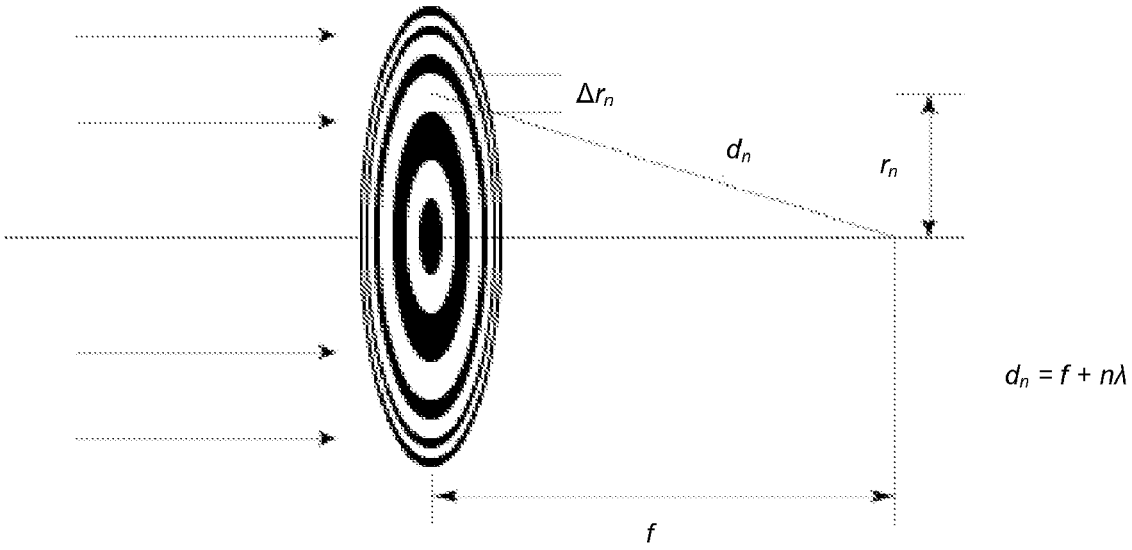
Figure 3B:
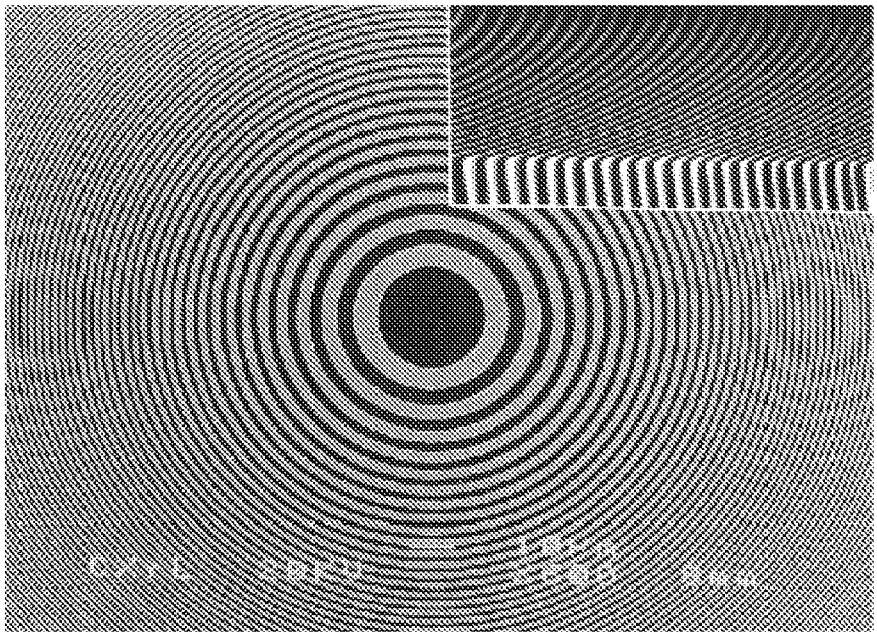

The highest resolution objective lens used in current x-ray imaging system are Fresnel zone plates. As shown in FIGS. 3*a* and 3*b*, the lenses are essentially circular diffraction gratings having concentric opaque or phase shifting rings arranged such that the radiation passing through them will arrive at the focal point in phase.

Lens with opaque rings are called amplitude zone plates and the lenses with phase shifting rings are called phase zone plates. The resolution of a zone plate is approximately the outer zone width.

It is clear from the geometric pictures in FIGS. 3*a* and 3*b* that the zone width becomes finer as the radius is increased. The challenge to producing high-resolution zone plate lenses is therefore the ability to make zone plates with finest outer zones.

The other aspect of an objective lens is its efficiency. To obtain the highest efficiency, the opaque rings of an amplitude zone plate should completely absorb the radiation, while the rings in an ideal phase zone plate should shift the phase by n.

With x rays, as the energy increases, both the attenuation length and the $\pi$ phase shift length generally increases. Therefore, the zone plate must be made with increasing thickness. This increases the thickness to zone width ratio, or the aspect-ratio of a zone plate. Therefore, it is generally more challenging to fabricate zone plates for high energy x rays for the same outer zone width because of the higher aspect ratio that is required.

Current fabrication techniques can provide objective lenses with about 25-30 nanometer resolution at Tungsten $M_\alpha$ line (1.8 keV) and about 70 nanometer resolution at Tungsten $L_\beta$ line (9.7 keV). An imaging system using the 1.8 keV x rays therefore provides better resolution in addition to the ten fold sensitivity for small features discussed above. Therefore having an imaging system that can utilize both emissions is more versatile than one using a single emission line, since a large sample can be imaged with the 9.7 keV emission while the 1.8 keV line can be used to image specific areas at high resolution.

Material selection clearly plays an important role in obtaining high resolution and high efficiency zone plates. For x rays with a few keV energy, a phase shifting zone plate is preferred, and ideal materials for the zone plate should provide low absorption and large phase shifts and also should have desirable electrochemical properties, e.g. it should be easily electroplated into nano-structures that are free from grains.

Figure 4A:
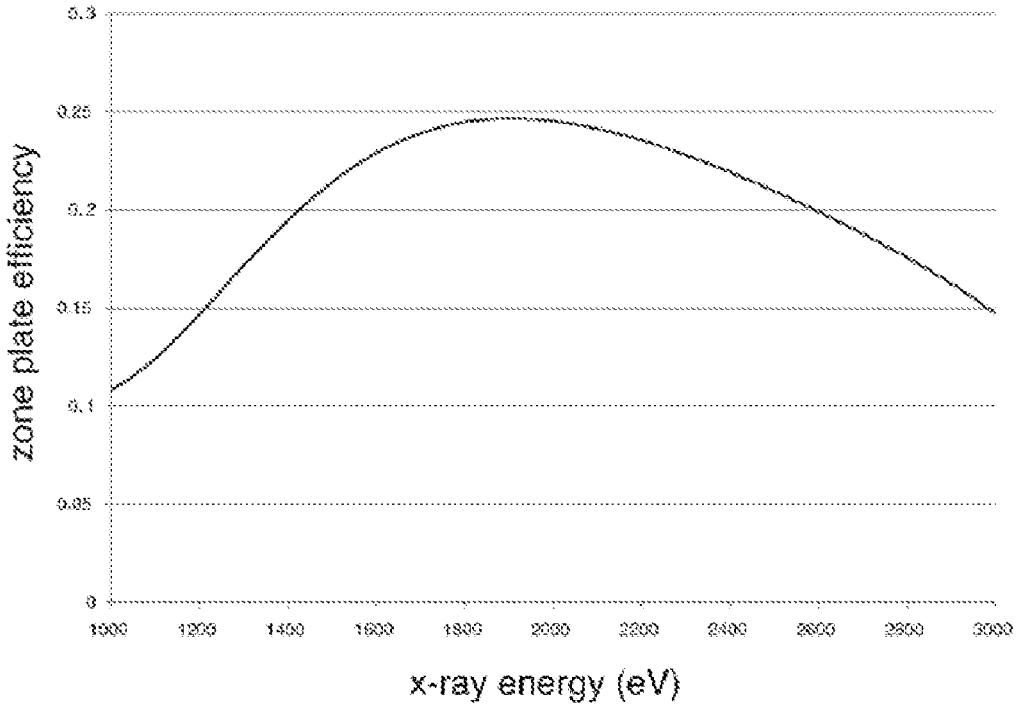
Figure 4B:
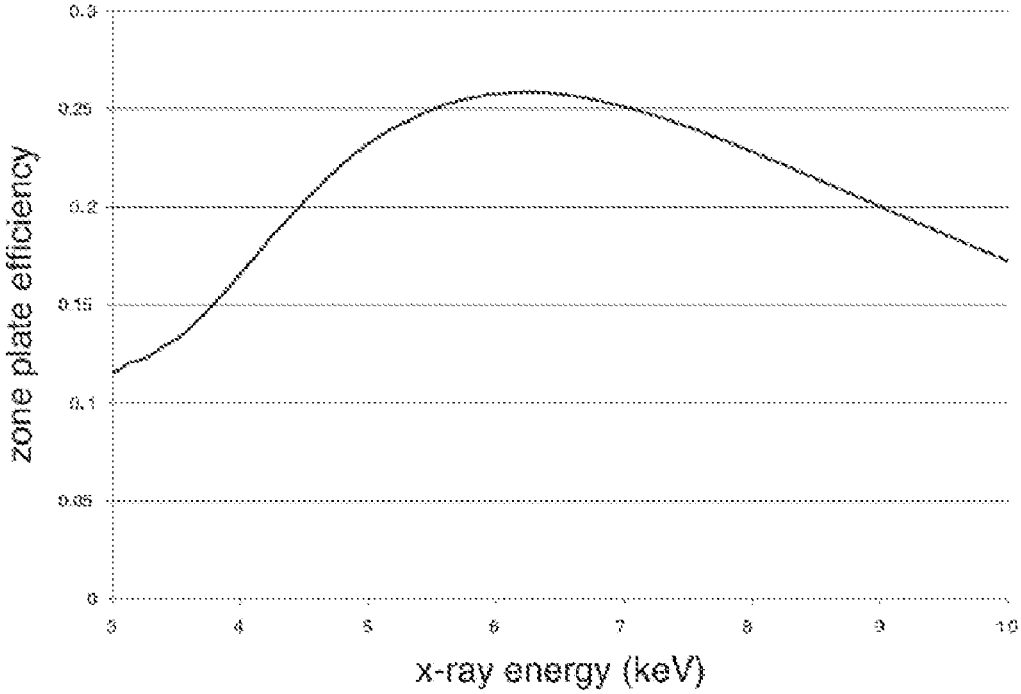

Currently, the preferred materials for zone plates for 1-3 keV x rays include rhodium (Rh), palladium (Pd), and silver (Ag), while the preferred material for 3-20 keV is gold (Au). As an example, FIGS. 4*a* and 4*b* show the efficiency as a function of energy for zone plates made from 500 nanometer thick Pd and 1 micrometer thick Au, respectively. In each case, efficiency of up to 25% to 30% can be achieved.

The other important component of the optical train is the detector system. High-resolution full-field imaging systems typically employ scintillated charge-coupled device (CCD) camera systems. These types of detectors typically have a scintilator, some type of optical coupling, and a CCD camera.

Figure 5:
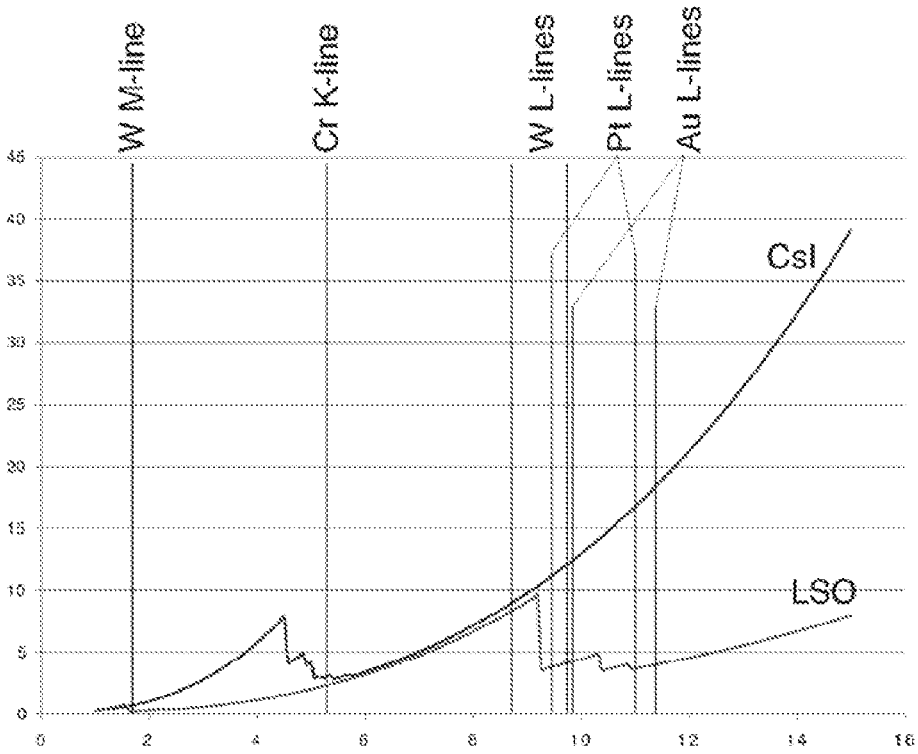
FIG. 5. Plot showing attenuation length of CsI and LSO as a function of x-ray energy. Also shown are emission lines of common x-ray source target materials: W, Cr, Pt, and Au.

The highest resolution variants of this type of detectors use a grainless single crystal scintillator and high resolution visible-light microscope objective lens to image the light emitted from the scintillator to the CCD camera. The achievable resolution of the objective lens is related to the numerical aperture (NA) as: resolution=$0.61\lambda/NA$, where $\lambda$ is the wavelength. The depth of field (DOF) from this objective can then be calculated as $DOF=1.22\lambda/NA^2$. To achieve high resolution, a microscope objective lens with a large numerical aperture is required. For example, in order to achieve better than 1 micrometer resolution with a scintillator with 600 nanometer emission wavelength, an objective with a NA of about 0.4 is needed. The depth of field from this objective lens is roughly 4.5 micrometers. It is therefore desirable that the most of the x rays impinging on the scintillator are absorbed within this depth because light generated outside this depth range will not be collected effectively by the objective lens, but rather will contribute the background. The scintillator material must therefore be matched to the x-ray energy used. We list two specific examples. Two types of scintillators known with high efficiency are Cesium Iodine with Thallium doping and $Lu_{2(1-x)}Ce_{2x}(SiO_4)O$ or LSO. Their attenuation length is shown in FIG. 5. A very short attenuation length can be achieve by the following source and scintillator combinations:

| | |
|---|---|
| 1.8 keV W M-line | CsI or LSO |
| 5.4 keV Cr K-line | CsI or LSO |
| 8.4 keV W $L_\alpha$ line | CsI or LSO |
| 9.7 keV W $L_\beta$ line | LSO |
| 9.4 keV and 11.1 keV Pt L lines | LSO |
| 9.7 keV and 11.4 keV Au L lines | LSO |

At the 8.4 keV W $L_\alpha$ line, neither of the scintillators provides sufficient attenuation, but from above 9.5 keV, LSO provides very effective attenuation for the 9.7 keV W $L_\alpha$ line, as well as L lines from Pt or Au sources. CsI has about 25% to 50% higher efficiency per unit absorbed energy, so in cases where CsI and LSO have similar attenuation length, CsI is generally preferred because of the higher level of light output. On the other hand, CsI has a number undesirable material properties: it is highly hydroscopic and very soft. Consequently, its fabrication and maintenance is difficult. In contrast, LSO is a very robust material that can be easily fabricated and polished, with good long term stability.

Figure 6:
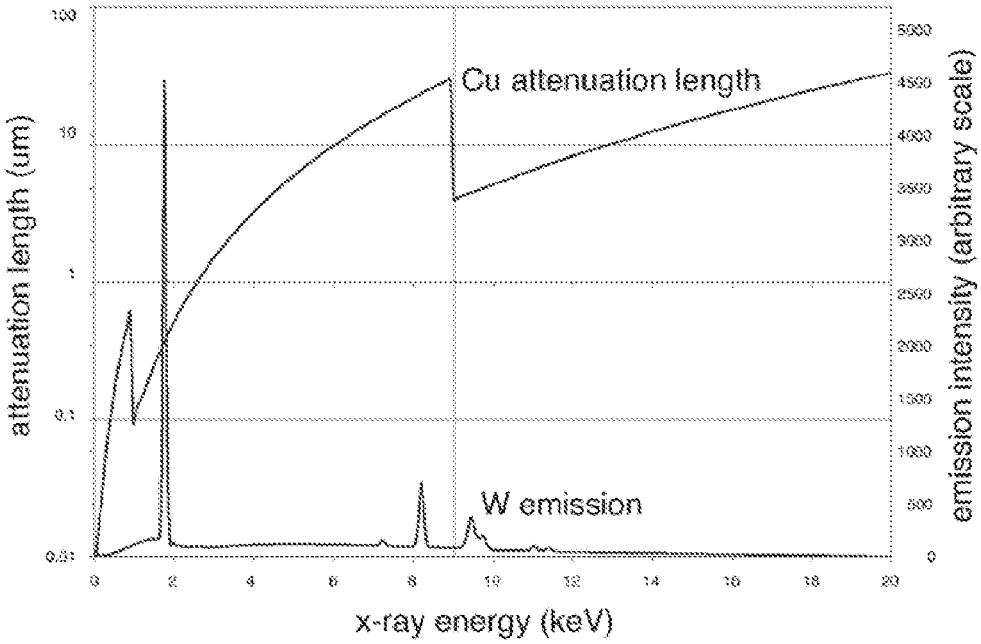
FIG. 6: Plot of Emission spectrum of Tungsten (W) and the absorption spectrum of copper, illustrating the use of multiple Tungsten emission lines to image copper features.

In addition to the systems described above that use a single atomic emission line for imaging specific materials, an x-ray imaging system can also utilize two or more emission lines to increase its versatility. For an example, a microscope for an imaging system could use all three emission lines of tungsten shown in FIG. 6 to image copper structures in a silicon substrate. Such a system uses the 8.4 keV line to image large scale structures, the 9.7 keV structure to obtain a linear absorption map of the sample or obtain its three dimensional structure, and the 1.8 keV line to study the fine features with extremely high sensitivity.

Figure 7:
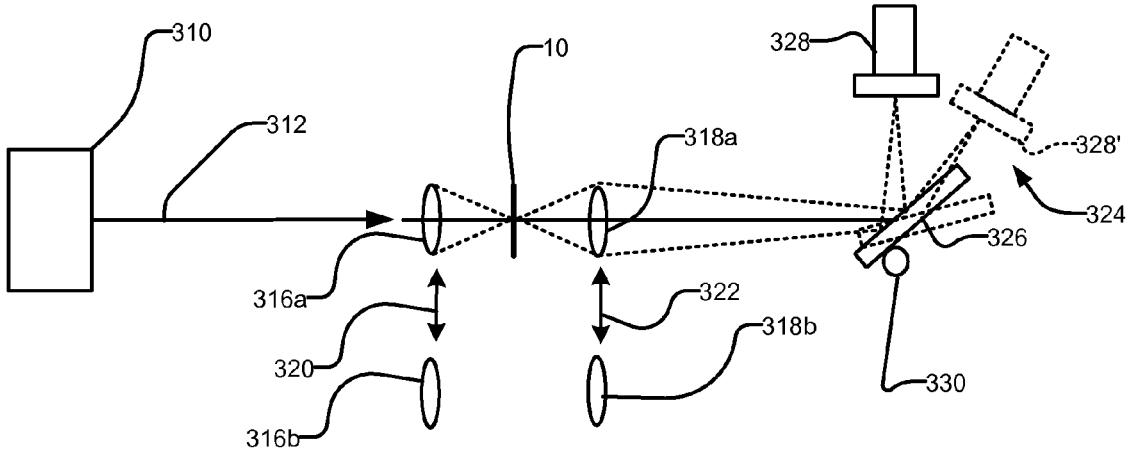
FIG. 7: Schematic diagram illustrating a micro-imaging system utilizing multiple emission lines of an x-ray source. The system shown uses a series of full-field imaging systems, one optimized for each energy. The sample is transferred between each imaging system to be imaged at different energies.

An embodiment of such a system is shown in FIG. 7. An x-ray source 310 generates polychromatic radiation 312 with characteristic emission lines and the Brehmstralung radiation.

In more detail, an x-ray beam 312 from a small spot size x-ray source 310 illuminates a sample 10. An electron bombardment laboratory X-ray source 30 is preferably used. These systems comprise an electron gun that generates an electron beam that is directed at a target. Typically, the target is selected from chromium, tungsten, platinum, silver molybdenum, rhodium and/or gold.

Multiple imaging systems 314, possibly one for each energy, are used. Preferably each of the imaging systems 314 comprises a condenser lens 316*a*, 316*b* and an objective lens 318*a*, 318*b*, with associated positioning systems 320, 322.

Specifically, condenser positioning system 320 is used to position the condenser of either the first imaging system 316*a* or the condenser of the second imaging system 316*b* into the optical train. Likewise, objective positioning system 322 is used to position the objective of the first imaging system 318*a* or the objective of the second imaging system 318*b* into the optical train.

Near the detector plane 324, an energy-selection device 326, such as for example a multilayer or crystal monochromator, reflects the radiation with desired energy to the detector 328. Depending on the energy selection, the imaging paths can share a single detector which will rotate with the monochromator using a pivot actuator 330 or a series of detectors 328, 328' each detector being optimized for a different energy.

Presently, the positioning of the energy selection device 326 in the back focal plane, i.e., between objective 318 and the detector 328 is preferred. Generally, the energy selection device is required because zone plates lenses need the monochromator or energy selector 326 to avoid chromatic aberration.

The placement near the detector is helpful because these monochromators 326 tend to have small angles of acceptance. However, because of the microscopes geometry, that is the distance between the sample 10 and objective 318 is small compared with the distance between the objective 318 and detector 328, the angular divergence of the beam is lower between the objective 318 and the detector 328.

Figure 8:
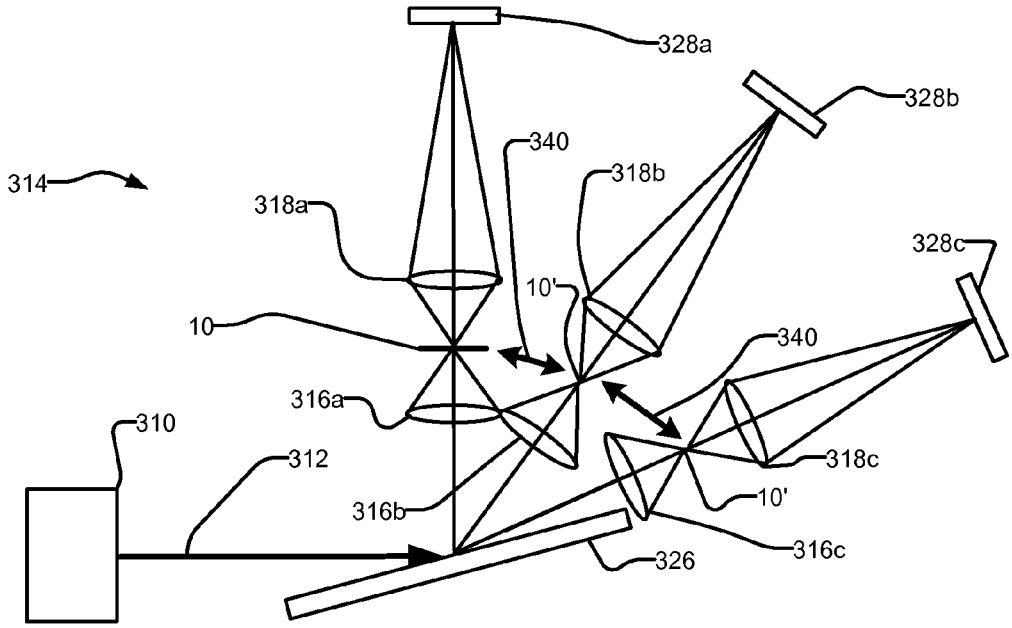
FIG. 8: Schematic diagram illustrating another embodiment in which an energy filter is used to select the energy, the sample remains fixed, and imaging system components for different energies, including condenser and objective lenses, are transferred into the beam line when the corresponding energy is selected.

An alternative embodiment is shown in FIG. 8, in which a monochromator 326 is placed just downstream of the x-ray source 310 and reflects the radiation with different energies into a number of prepositioned imaging systems 314, one designed for each energy. In this case the sample 10 will be translated by a sample translator 340 to positions 10' between systems to be imaged at different energies.

Specifically, a first condenser 316*a* and first objective 318*a* are used to form an image on a first detector 328*a*; a second condenser 316*b* and second objective 318*b* are used to form an image on a second detector 328*b*; and a third condenser 316*c* and third objective 318*c* are used to form an image on a third detector 328*c*.

The disadvantage of this design, in comparison with one illustrated in FIG. 7, is that the bandwidth of the monochromator must be large enough to cover the angular acceptance of the condenser lenses 316*a, b, c*. Therefore it is suited for cases where the numerical aperture of the imaging system is relatively low.

Figure 9:
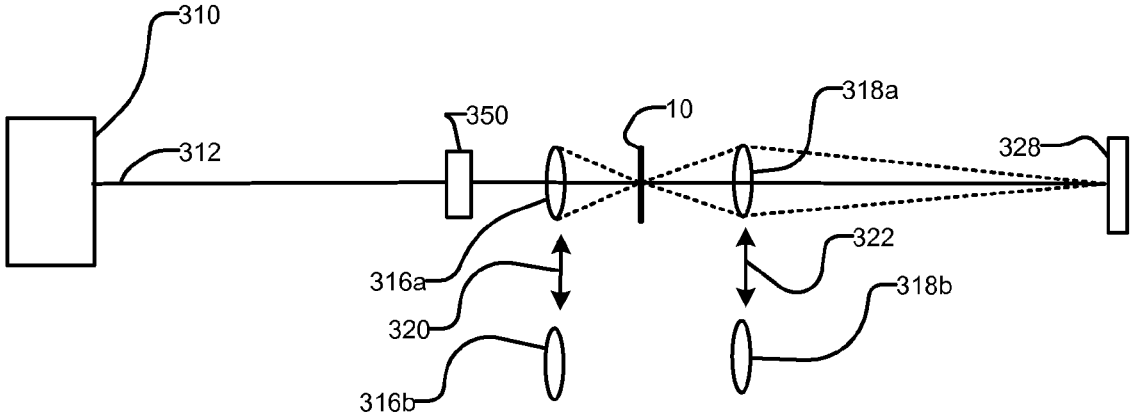
FIG. 9. Schematic diagram illustrating another embodiment

In special cases where one or more characteristic emission lines can be selected by an in-line filter, a design shown in FIG. 9 provides a simple implementation. In this embodiment, the in-line filters 350 are inserted into the beam 312 to select beam energy while the corresponding imaging systems 314, each comprising condensers 316*a, b* and objective lenses 318*a, b* are selectively inserted into the beam path 312 to perform the imaging.

Figure 10:
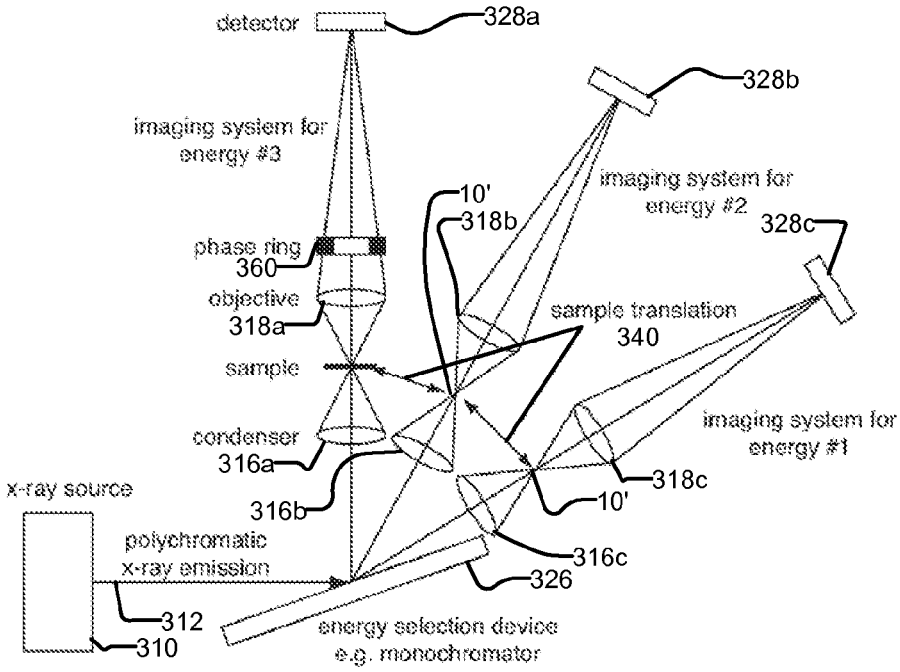
FIG. 10: Schematic diagram illustrating another embodiment in which a number of independent imaging systems are used, one optimized for each energy, and in which one or more of the imaging systems are in a phase-contrast imaging configuration.

In some implementations, metal film energy filters are used to select the 1.8 keV energy. Further, selectivity is achieved by further pairing the filter 350 with thin scintillators to select the 1.8 keV energy.

Where three emission lines of tungsten are used to image copper features in silicon substrate, the imaging system for one or more energies may employ different contrast mechanisms. A design for such a system is shown in FIG. 10. This system is similar to that shown in FIG. 8, except that imaging system for energy #3 uses a Zernike phase contrast scheme, including a phase plate 360, while others "b" and "c" use the bright-field mode.

In other examples, wherein the different contrast mechanisms include absorption contrast, phase contrast, and/or Nomarski interference contrast.

Figure 11:
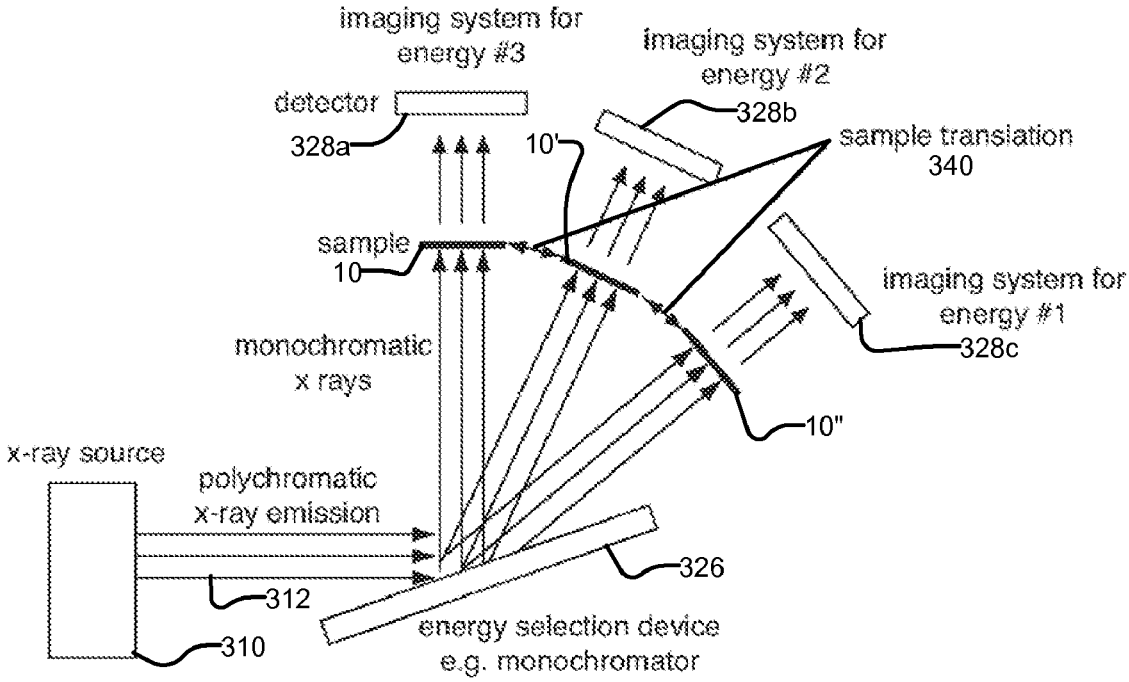
FIG. 11: Schematic diagram illustrating another embodiment in which a number of independent imaging systems are used, one optimized for each energy, with one or more of the imaging systems functioning in a projection geometry. The imaging system may contain a mixture of different configurations including, but not limited to, full-field imaging systems, scanning systems, and projection systems.

Beside imaging systems that employ lenses to magnify the image, the energy optimization and imaging schemes discussed above also apply to simpler imaging systems such as direct projection configurations as shown in FIG. 11, where a monochromator 326 is placed just downstream of the x-ray source 310 and directs the radiation 312 of different energies to corresponding imaging systems.

The radiation 312 is generally collimated since condenser and possibly no objective are used. In each imaging system, detector 328*a*, 328*b*, 328*c* are place directly behind the samples 10, 10', 10" to record the spatial radiation pattern transmitted through it.

Figure 12:
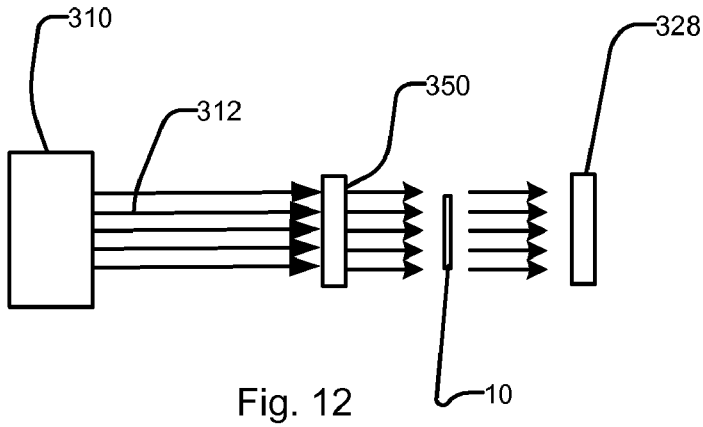
FIG. 12: Schematic diagram illustrating another embodiment in which an energy filter is used to select the energy with a direct-projection imaging system or more than one imaging systems that may include and not limited to full-field imaging system, scanning system, and projection systems.

A variation of this system is shown in FIG. 12, where the monochromator is replaced by a in-line energy filter 350 in the projection system.

While this invention has been particularly shown and described with references to preferred embodiments thereof, it will be understood by those skilled in the art that various changes in form and details may be made therein without departing from the scope of the invention encompassed by the appended claims.

What is claimed is:

1. An imaging method for an x-ray imaging system, comprising:

generating x-rays of a 8.4 keV $L_\alpha$-line from a tungsten x-ray source;

directing the x-rays at integrated circuits with copper structures on a silicon substrate; and forming an image of the copper structures on a detector using the x-rays.

2. An x-ray imaging method as claimed in claim 1, further comprising:

using a monochromator that selects the 8.4 keV energy; and using a detector for detecting the 8.4 keV energy from the monochromator and a sample comprising the integrated circuits; and placing a zone plate objective, between the sample and the detector, for focusing the 8.4 keV energy to form an image of the copper structures in the sample on the detector.

3. An x-ray imaging method as claimed in claim 2, wherein the monochromator is a crystal monochromator to select the 8.4 keV energy.

4. An x-ray imaging method as claimed in claim 2, wherein the monochromator is a multilayer monochromator to select the 8.4 keV energy.

5. An x-ray imaging method as claimed in claim 2, wherein the monochromator is a metal film energy filter to select the 8.4 keV energy.

6. An x-ray imaging method as claimed in claim 5, further comprising a thin scintillator further providing selectivity for the 8.4 keV energy.

7. An x-ray imaging method as claimed in claim 1, further comprising imaging structures in phase contrast.

8. An x-ray imaging method as claimed in claim 1, further comprising imaging structures in absorption contrast.

9. An imaging method for an x-ray imaging system, comprising:

generating x-rays of a 8.4 keV $L_\alpha$-line from a tungsten x-ray source;

directing the x-rays at integrated circuits with copper structures and a dielectric substrate; and forming an image of the copper structures on a detector using the x-rays in phase or absorption contrast.

* * * * *